US007377145B2

(12) United States Patent
Chen

(10) Patent No.: US 7,377,145 B2
(45) Date of Patent: May 27, 2008

(54) KEY CASE

(76) Inventor: Han Ching Chen, No. 46, JhuangNei Rd., YaunChang Township, YunLin County (TW)

( * ) Notice: Subject to any disclaimer, the term of this patent is extended or adjusted under 35 U.S.C. 154(b) by 83 days.

(21) Appl. No.: 11/546,373

(22) Filed: Oct. 12, 2006

(65) Prior Publication Data

US 2008/0087062 A1 Apr. 17, 2008

(51) Int. Cl.
*A47G 29/10* (2006.01)
*A45C 11/32* (2006.01)

(52) U.S. Cl. ..... 70/456 R; 206/37.2

(58) Field of Classification Search ..... 206/37.1–37.8, 206/38.1; 70/344, 393, 455, 456 R
See application file for complete search history.

(56) References Cited

U.S. PATENT DOCUMENTS 3,137,157 A * 6/1964 Ralton ..... 70/456 R
3,328,986 A * 7/1967 Ralton ..... 70/456 R
5,232,086 A * 8/1993 Montanari ..... 206/37.2
6,237,756 B1 * 5/2001 Caudle ..... 206/37.2
6,474,123 B1 * 11/2002 Kito et al. ..... 70/456 R
2007/0079639 A1 * 4/2007 Hsu ..... 70/456 R

* cited by examiner

*Primary Examiner*—Luan K Bui
(74) *Attorney, Agent, or Firm*—Rabin & Berdo, P.C.

(57) ABSTRACT

A key case includes a top plate slidably mounted on two rails on a bottom plate, and a key is movably received in a space between the two rails. A first block is connected to an end of a blade portion of the key and has a stop which is engaged with a push member on an underside of the top plate so that when the top plate is pushed, the blade portion of the key extends out from an opening defined in an end of the key case. The first block is connected with a first spring member that can pull the key back to its original position. Two push bars each have a first protrusion to be engaged with two notches of the first block to position the key. The two push bars can be pivoted to release the first protrusions from the notches to allow the key to be pulled back by the first spring member.

8 Claims, 8 Drawing Sheets

KEY CASE

BACKGROUND OF THE INVENTION

1. Field of the Invention

The present invention relates generally to a key case in which a key is retractably received therein.

2. The Prior Arts

A conventional key generally includes a blade portion and a bow portion, the blade portion includes serration and warding so as to be inserted into a key hole and a user holds the bow portion to rotate the key to unlock a lock. The total length of the conventional key is the sum of the blade portion and the bow portion, and the length of the conventional key is too long to be easily stored. The serration of the blade portion is sharp so that if the key is simply put into a pocket or purse, the sharp serration might scrub objects such as cellular phone or MP3. Although there is a bag for storing the keys in the market, the bag is bulky and not convenient to be carried and stored. Besides, the key bag has to be long enough to receive the length of the bow portion and the blade portion. The user has to open the bag and then pick the correct one of the keys to unlock the door, and then the key is re-stored into the bag and zip the bag again. The procedures take time.

The present invention is to provide a key case wherein the key is retractably stored in the case and does not have the bow portion so that the length of the unit of the key case and the key is shorter. The blade portion can be pushed out by pushing a top plate of the key case, and the key is received into the case by operation of two push bars.

SUMMARY OF THE INVENTION

The present invention is to provide a key case which comprises a case having a top plate and a bottom plate, wherein the top plate is slidably mounted on two rails on the bottom plate and an opening is defined in a front end of the case. A push member extends from an underside of the top plate and a space is defined between the two rails. A key is movably received in the space and has a blade portion. A first block is connected to an end of the blade portion and a stop is formed in the first block. The stop is engaged with the push member when the top plate is slid along the rails to move the blade portion out from the opening. The first block has two notches defined in two sides thereof and a first spring member has a first end connected to the first block. A second end of the first spring member is connected with a second block which is fixed on the bottom plate. A second spring member has a first end connected to the second block and a second end of the second spring member is connected to the top plate. An operation unit includes two push bars which are pivotably connected to two sides of the case and each push bar has a first protrusion extending toward the space. The first protrusions are located close to the opening so as to be engaged with the notches of the key when the key is pushed out from the opening. Each push bar has a push end and a second protrusion which is located between the first protrusion and the push end. The second protrusion is a fulcrum so that when pushing the push end, the first protrusion is disengaged from the notch.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
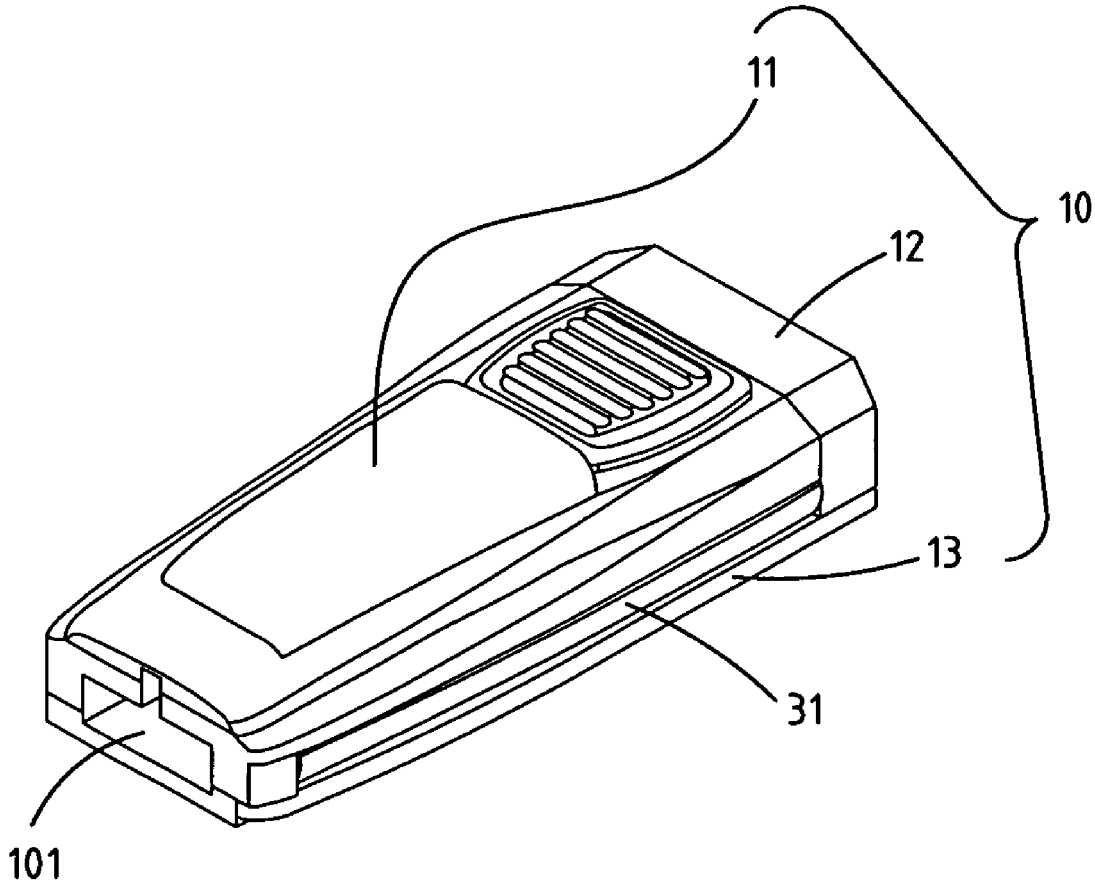
FIG. 1 is a perspective view showing a key case in accordance with the present invention.
Figure 2:
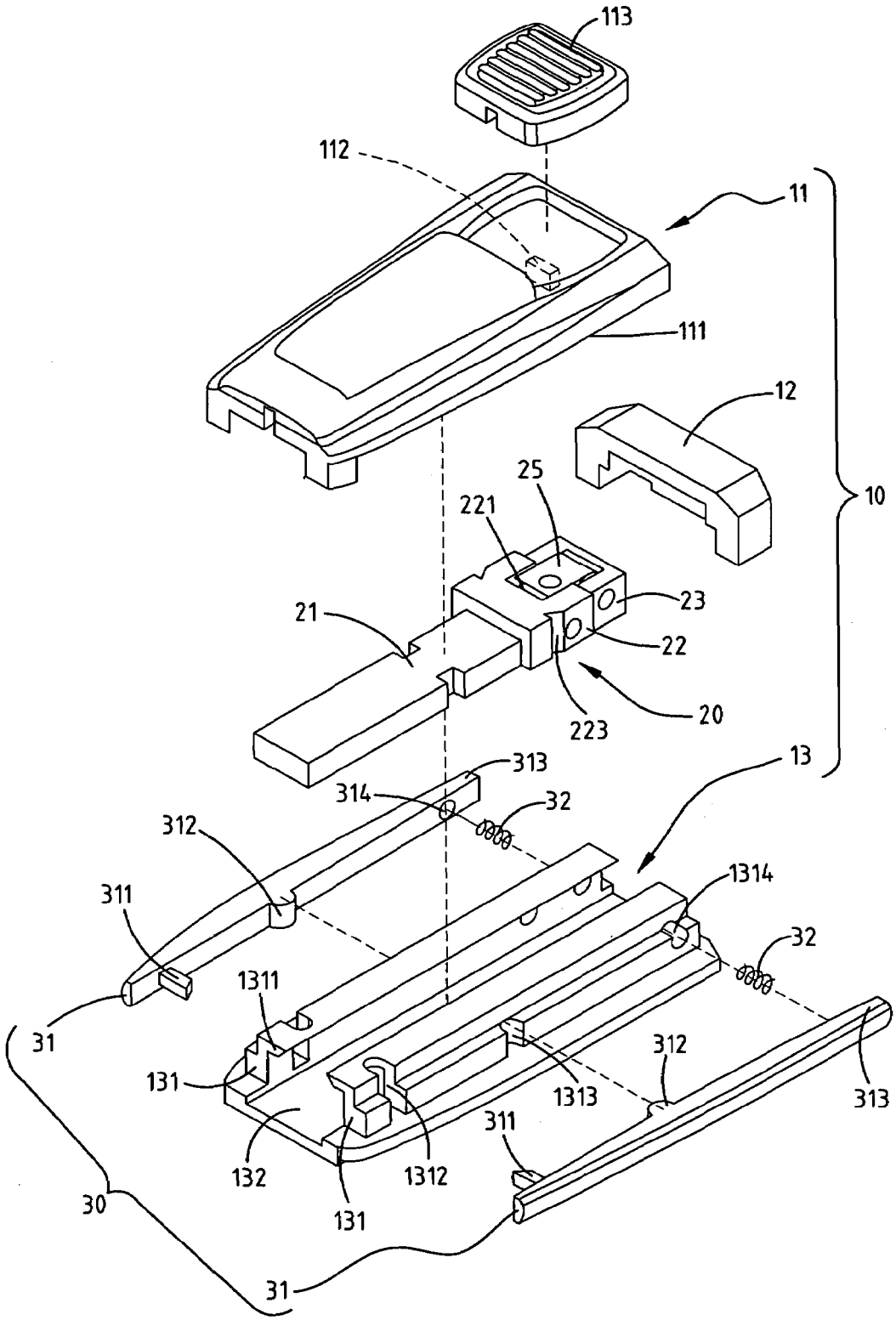
FIG. 2 is an exploded view of the key case in accordance with the present invention.
Figure 3:
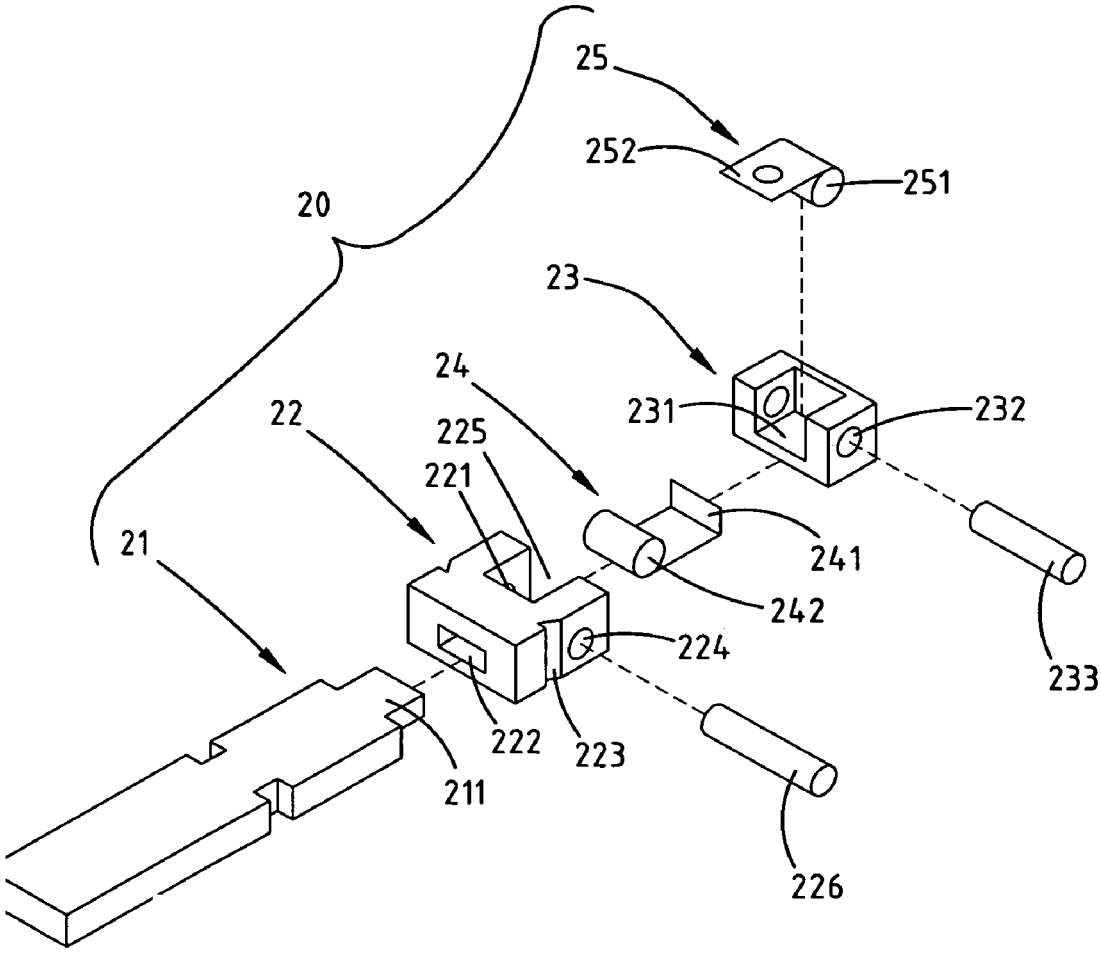
FIG. 3 is an exploded view of a key received in the case in accordance with the present invention.
Figure 4:
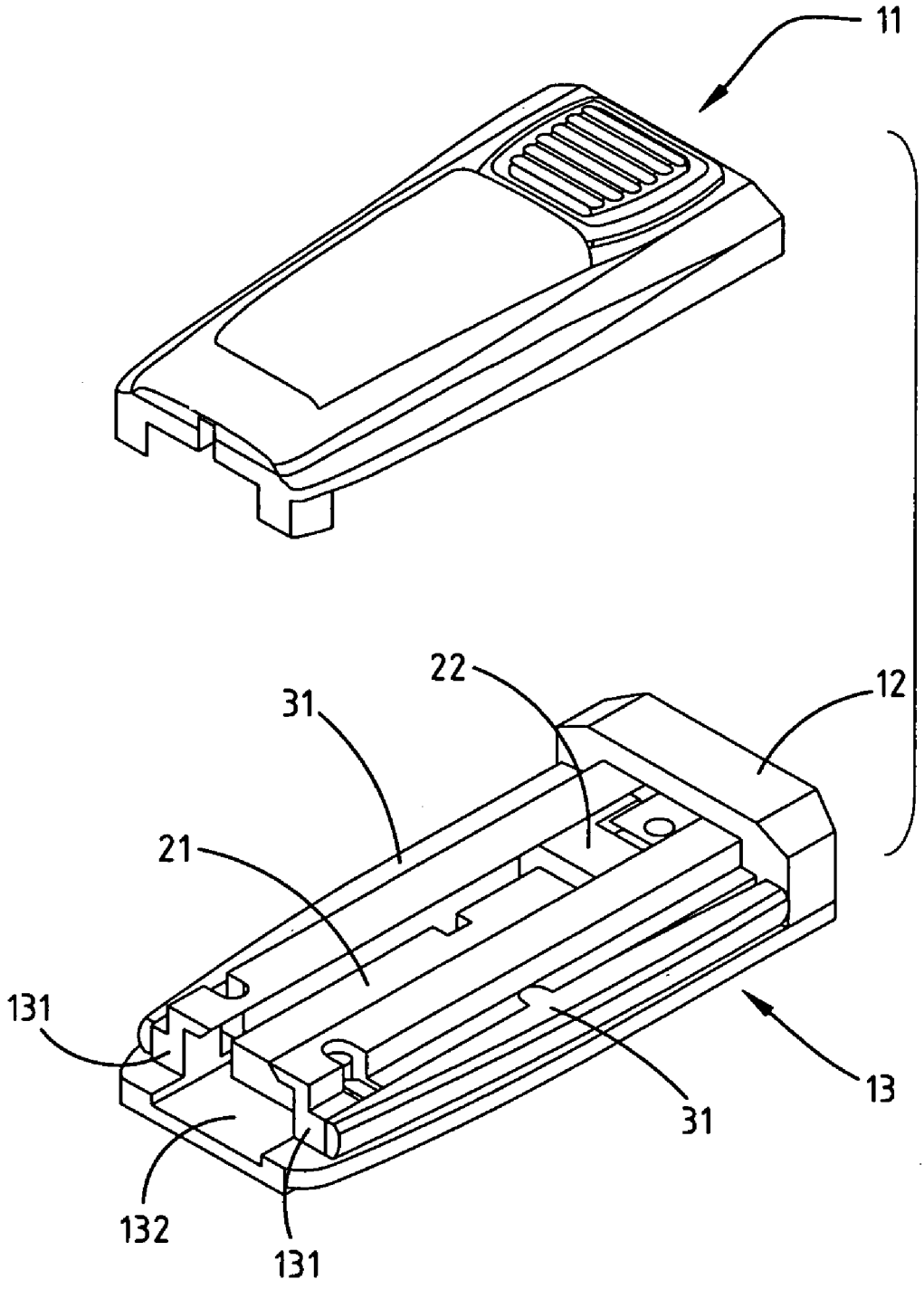
FIG. 4 shows a perspective view of a bottom plate with a rear cap and a top plate of the key case in accordance with the present invention.

With reference to the drawings and in particular to FIGS. 1-4, a key case 10 in accordance with the present invention comprises a top plate 11, a bottom plate 13 and a rear cap 12 which is connected to a rear end of the bottom plate 13. The top plate 11 is slidably mounted on two rails 131 on the bottom plate 13 and an opening 101 is defined in a front end of the case 10 and located between the top plate 11 and the bottom plate 13. A space 132 is defined between the two rails 131 so as to receive a key 20 therein. Each rail 131 further has a guide portion 1311 which guides the key 20 to be moved along the longitudinal direction of the case 10. A push member 112 extends from an underside of the top plate 11 and a friction pad 113 is connected to a top surface of the top plate 11 so that a user can easily push the top plate 11 as shown in FIG. 5.

The key 20 has a blade portion 21 and an insertion 211 extends from a rear end of the blade portion 21. A first block 22 has a receiving hole 222 defined in an end thereof and the insertion 211 is securely received in the receiving hole 222. The first block 22 has a first recess 225 which is defined by two sidewalls and each sidewall has a first hole 224 defined therethrough. A first end 242 of a first spring member 24 is located in the first recess 225 and a first pin 226 extends through the first holes 224 and the first end of the first spring member 24. The first spring member 24 is a torsion spring. A stop 221 is formed in the first-block 22 and located in the first recess 225. The first block 22 has two notches 223 defined in two sides thereof. A second end 241 of the first spring member 24 is connected with a second block 23 which is fixed on the bottom plate 13. A second spring member 25 that is a torsion spring has a first end 251 connected to the second block 23 and a second end 252 of the second spring member 25 is connected to the top plate 11. The second block 23 has a second recess 231 which is defined by two sidewalls and each sidewall has a second hole 232 defined therethrough, the first end 251 of the second spring member 25 is located in the second recess 231 and a second pin 233 extends through the second holes 232 and the first end 251 of the second spring member 25.

An operation unit 30 includes two push bars 31 which are pivotably connected to two sides of the case 10 and positioned by two sides 111 of the top plate 11. Each push bar 31 has a first protrusion 311 extending toward the space 132 and the first protrusions 311 locates close to the opening 101. The rails 131 each have a hole 1312 defined therethrough and the first protrusions 311 extend through the holes 1312. The rails 131 each further have a recess 1313 defined in an outside thereof and a second protrusion 312 on each of the push bar 31 is pivotably engaged with the recesses 1313. Each push bar 31 has a push end 313 and the second protrusion 312 is located between the first protrusion 311 and the push end 313. The second protrusion 312 is a fulcrum so that when pushing the push end 313, the first protrusion 311 is disengaged from the notch 223, which will be described later. A third spring member 32 is located between each of the push end 313 and the rail 131, wherein each rail 131 has a dent 1314 to receive an end of the third spring member 32.

Figure 5:
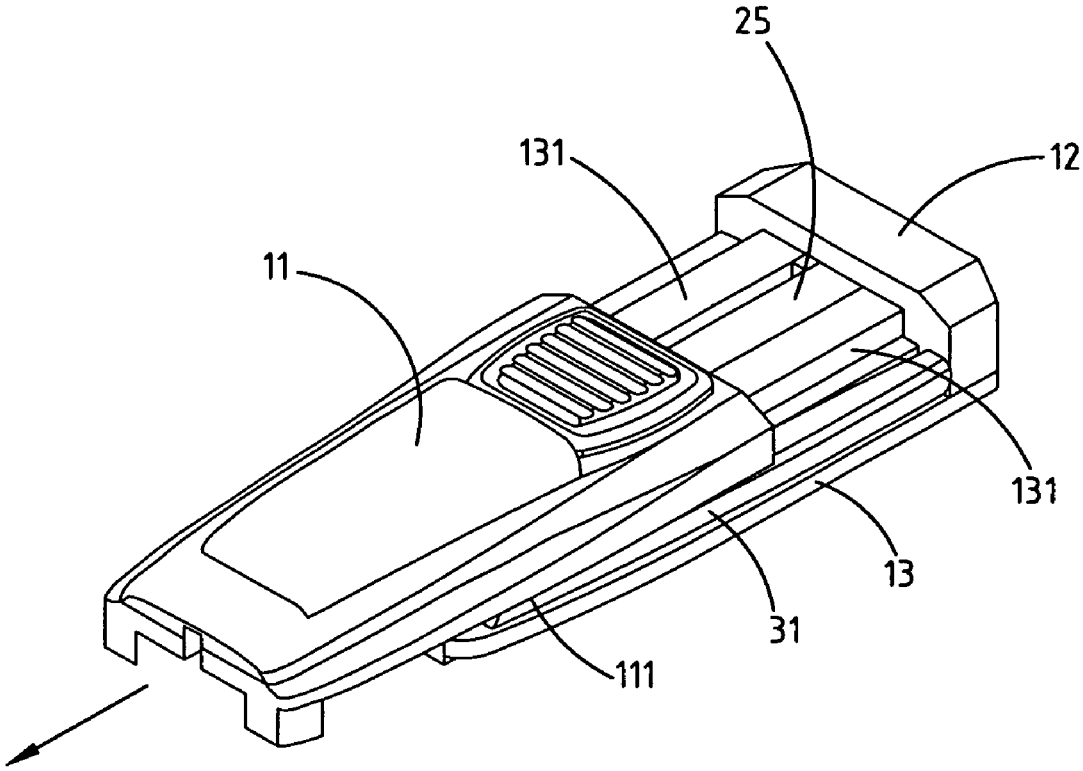
FIG. 5 shows that the top plate is pushed forward.
Figure 6:
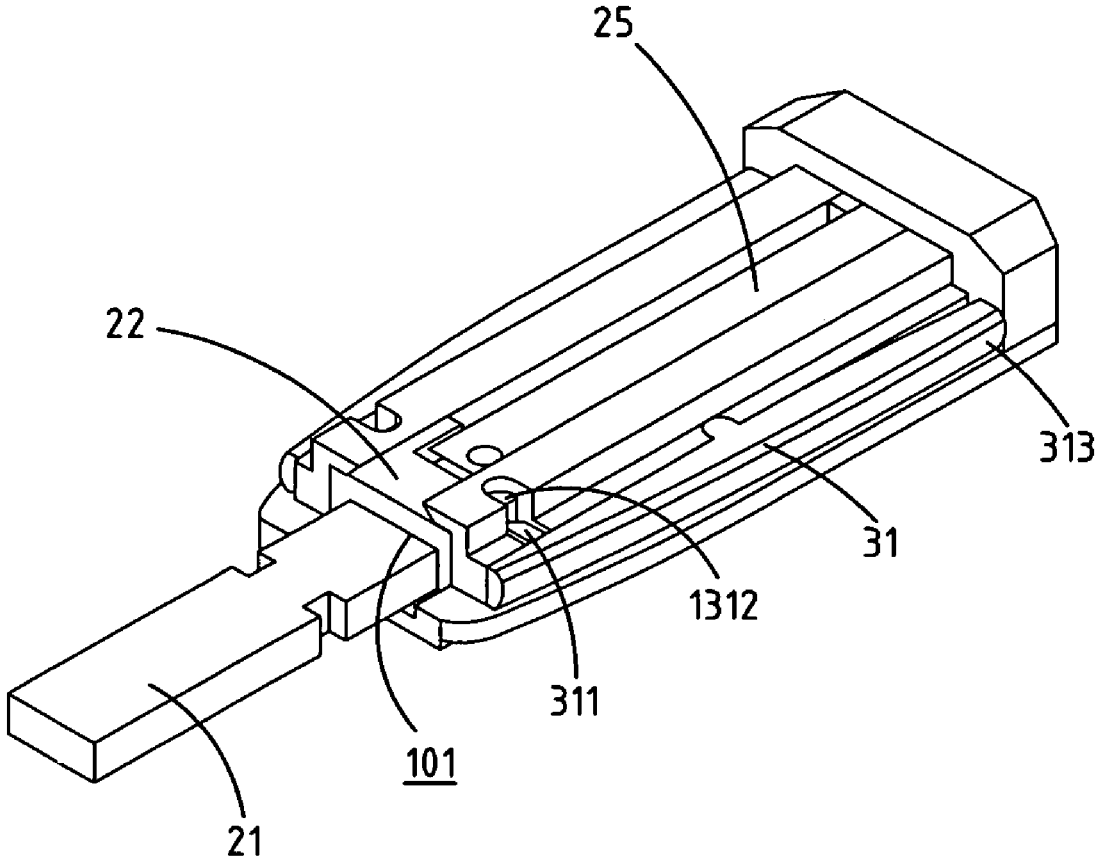
FIG. 6 shows that the key is pushed out from an opening and positioned.
Figure 7:
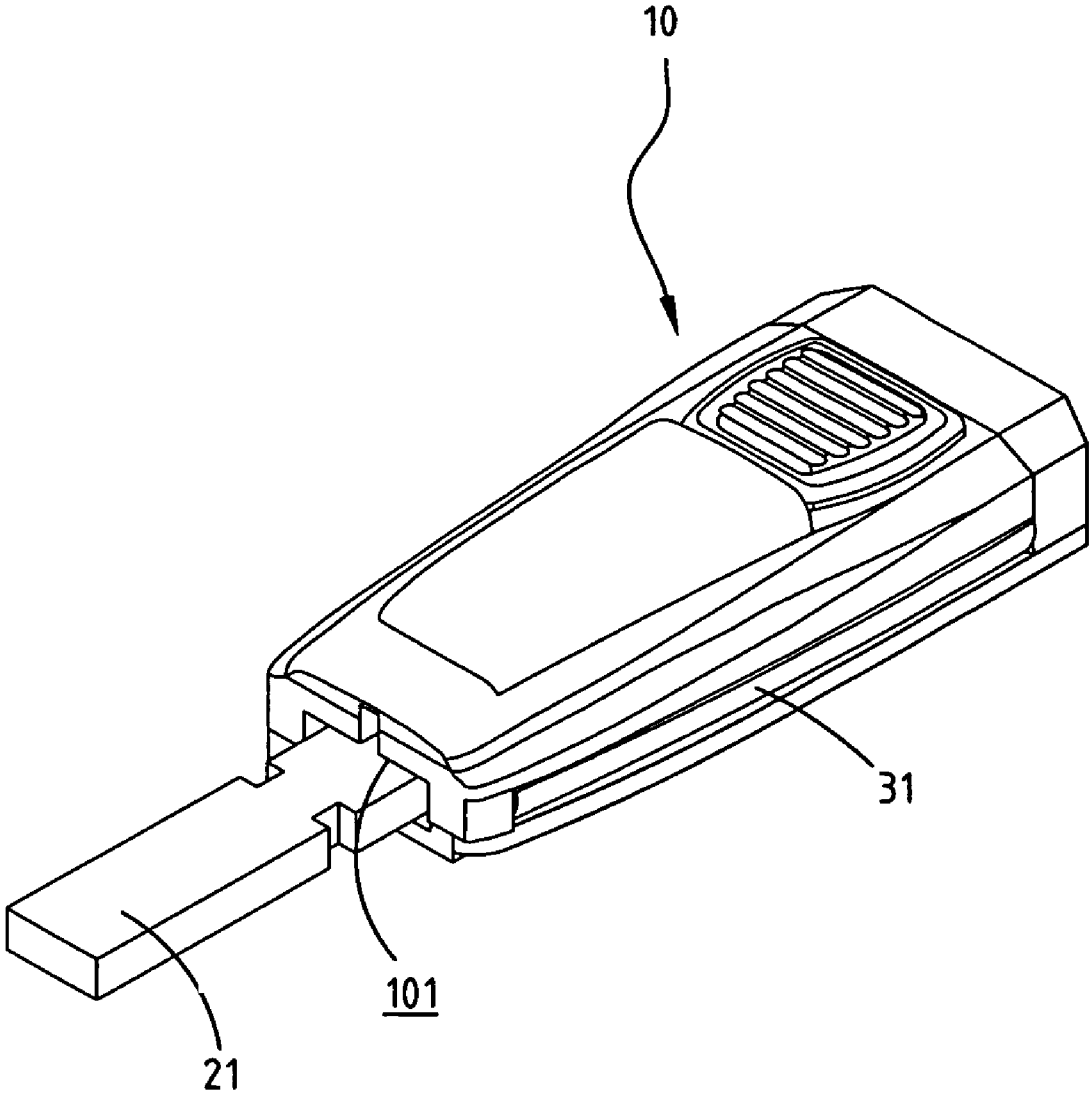
FIG. 7 shows that the key extends out from the opening of the case and positioned.
Figure 8:
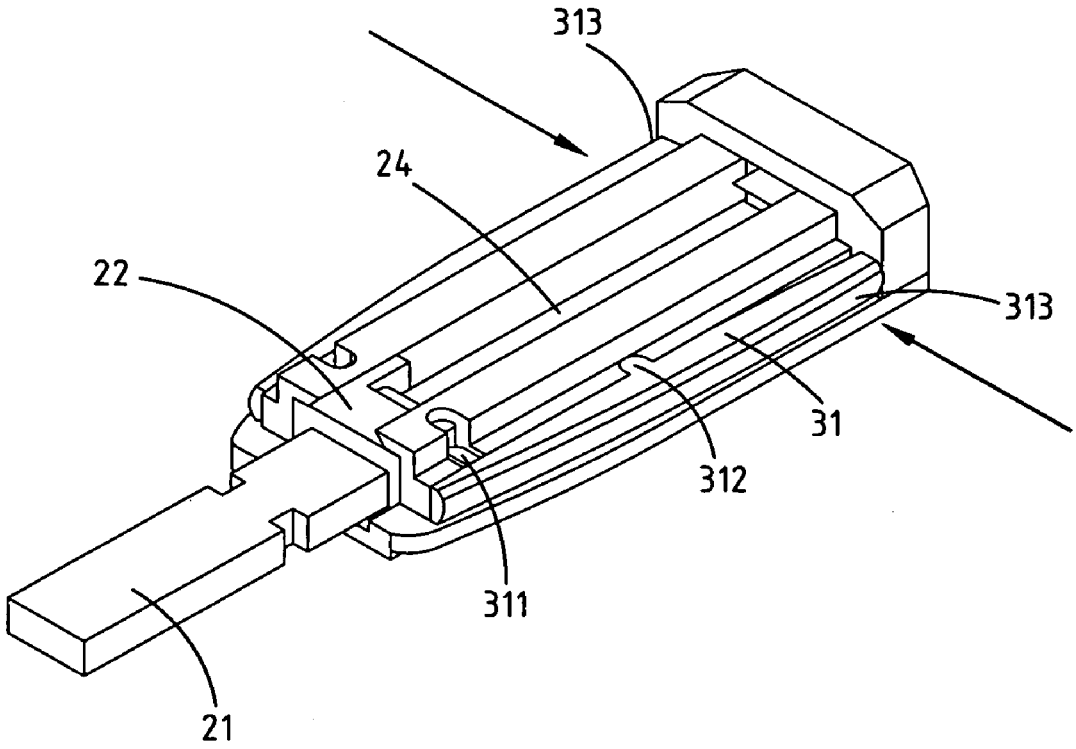
FIG. 8 shows that two first protrusions are disengaged from notches of the key by pushing two push bars.

As shown in FIGS. 5-7, when using the key case 10, the user pushes the top plate 11 along the rails 131 and away from the rear cap 12, the stop 221 of the first block 22 is engaged with the push member 112 of the top plate 11 so that the blade portion 21 is pushed out from the opening 101. The key 20 is positioned when the first protrusions 311 are engaged with the notches 223. It is noted that the third spring members 32 push the push ends 313 outward so that the first protrusions 311 are kept to be inserted into the space 132. When the top plate 11 is released, the second spring member 25 pulls the top plate 11 back to its original position. The user then holds the key case 10 to unlock a lock. After use, the user can push the two push ends 313 inward, the two push bars 31 are then pivoted about the second protrusions 312 so that the two first protrusions 311 are disengaged from the notches 223 of the key 20, so that the key 20 is pulled back by the first spring member 24.

Accordingly, the key 20 does not need a bow portion so that the total length of the key 20 is shorter than the conventional key. Besides, the blade portion 21 of the key 20 is hidden in the key case 10 so that it can be stored with other objects in pockets or purses.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A key case, comprising:

a case having a top plate and a bottom plate, the top plate slidably mounted on two rails on the bottom plate and an opening defined in a front end of the case and located between the top plate and the bottom plate, a push member extending from an underside of the top plate and a space defined between the two rails;

a key movably received in the space and having a blade portion, a first block connected to an end of the blade portion and a stop formed in the first block, the stop being engaged with the push member when the top plate is slid along the rails to move the blade portion out from the opening, the first block having two notches defined in two sides thereof and a first spring member having a first end connected to the first block, a second end of the first spring member connected with a second block which is fixed on the bottom plate, a second spring member having a first end connected to the second block and a second end of the second spring member connected to the top plate; and an operation unit including two push bars which are pivotably connected to two sides of the case and each push bar having a first protrusion extending toward the space, the first protrusions located close to the opening so as to be engaged with the notches of the key when the key is pushed out from the opening, each push bar having a push end and a second protrusion which is located between the first protrusion and the push end, the second protrusion being a fulcrum so that when pushing the push end, the first protrusion is disengaged from the notch.

2. The key case as claimed in claim 1, wherein the rails each have a hole defined therethrough and the first protrusions extend through the holes, the rails each have a recess defined in an outside thereof and the second protrusions are engaged with the recesses.

3. The key case as claimed in claim 1, wherein the top plate has a friction pad connected to a top surface thereof.

4. The key case as claimed in claim 1, wherein the first spring member is a torsion spring.

5. The key case as claimed in claim 4, wherein the first block has a first recess which is defined by two sidewalls and each sidewall has a first hole defined therethrough, the first end of the first spring member is located in the first recess and a first pin extends through the first holes and the first end of the first spring member.

6. The key case as claimed in claim 1, wherein the second spring member is a torsion spring.

7. The key case as claimed in claim 1, wherein the second block has a second recess which is defined by two sidewalls and each sidewall has a second hole defined therethrough, the first end of the second spring member is located in the second recess and a second pin extends through the second holes and the first end of the second spring member.

8. The key case as claimed in claim 1, wherein a third spring member is located between each of the push end and the rail.

* * * * *